United States Patent [19]

Snell

[11] Patent Number: 4,947,991

[45] Date of Patent: Aug. 14, 1990

[54] NON-SKID BEVERAGE AND/OR FOOD HOLDER

[75] Inventor: Richard B. Snell, Longwood, Fla.

[73] Assignee: Sea Rose II, Altamonte Springs, Fla.

[21] Appl. No.: 341,365

[22] Filed: Apr. 21, 1989

[51] Int. Cl.[5] ..... B65D 71/00

[52] U.S. Cl. ..... 206/427; 206/562; 211/74; 211/126; 220/21

[58] Field of Search ..... 108/111; 206/199, 203, 206/427, 562, 563; 220/20, 21; 211/74, 77, 86, 126, 133, 189; 248/105, 108, 128, 603, 615, 635

[56] References Cited

U.S. PATENT DOCUMENTS

| | | | |
|---|---|---|---|
| 1,270,095 | 6/1918 | Baehr | 211/74 |
| 1,762,596 | 6/1930 | Soper | 211/126 |
| 1,770,927 | 7/1930 | Ipsen | 206/199 |
| 2,723,037 | 11/1955 | Matesic | 211/74 |
| 3,215,308 | 11/1965 | Finley et al. | 206/199 |
| 3,331,515 | 7/1967 | Lange | 211/77 |
| 3,783,801 | 1/1974 | Engman | 108/111 |
| 3,893,569 | 7/1975 | Hoch | 211/74 |
| 4,480,343 | 11/1984 | Drach | 211/126 |
| 4,836,403 | 6/1989 | Blackman | 220/85 H |

FOREIGN PATENT DOCUMENTS

| | | | |
|---|---|---|---|
| 2935996 | 4/1981 | Fed. Rep. of Germany | 206/562 |
| 0015983 | of 1913 | United Kingdom | 206/563 |
| 0617861 | 2/1949 | United Kingdom | 220/21 |

*Primary Examiner*—Jimmy G. Foster
*Attorney, Agent, or Firm*—Julian C. Renfro

[57] ABSTRACT

A beverage and/or food holder in accordance with this invention is principally constituted by first and second planar members, each approximately of the same size and of generally rectangular configuration. A first of the planar members has a plurality of apertures formed therein, in each of which apertures, a container for a beverage, food item or the like can be placed. The planar members are maintained in a spaced apart, essentially parallel relationsip by the use of columnar members utilized at or near the corners of the planar members. Advantageously, this beverage and/or food item holder utilizes a plurality of non-skid members on the underside of the second planar member, to resist displacement of the beverage and/or food item holder along a surface upon which it has been placed. I prefer for the beverage and/or food item holder to be reversible, being usable with either the first or the second planar member in the uppermost position, and with a plurality of non-skid members being utilized on the side of each planar member that faces away from the other planar member. The second planar member can have apertures in which food or beverage items can be placed, or it can be imperforate, and usable as a cutting board.

13 Claims, 3 Drawing Sheets

FIG 1
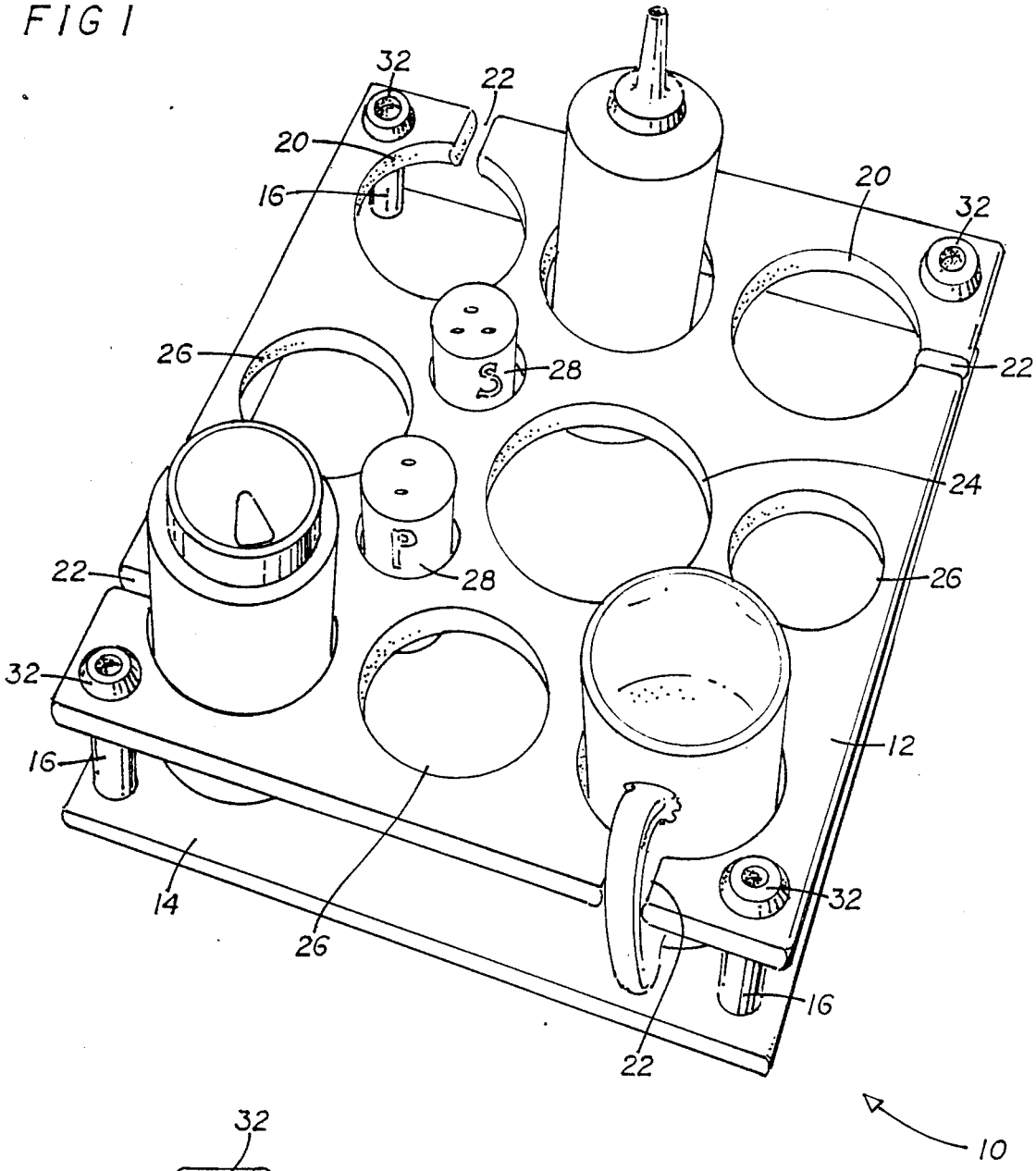
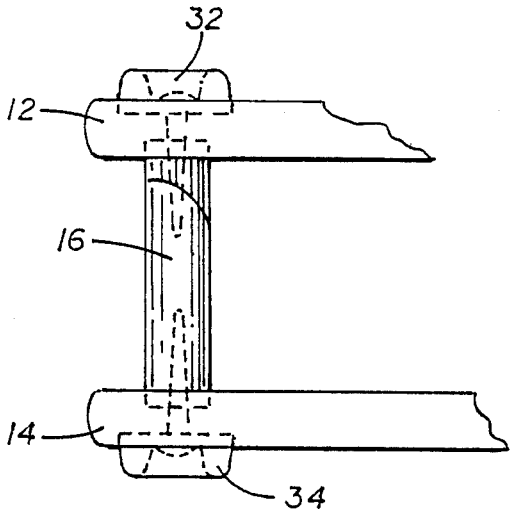
FIG 2

FIG 3
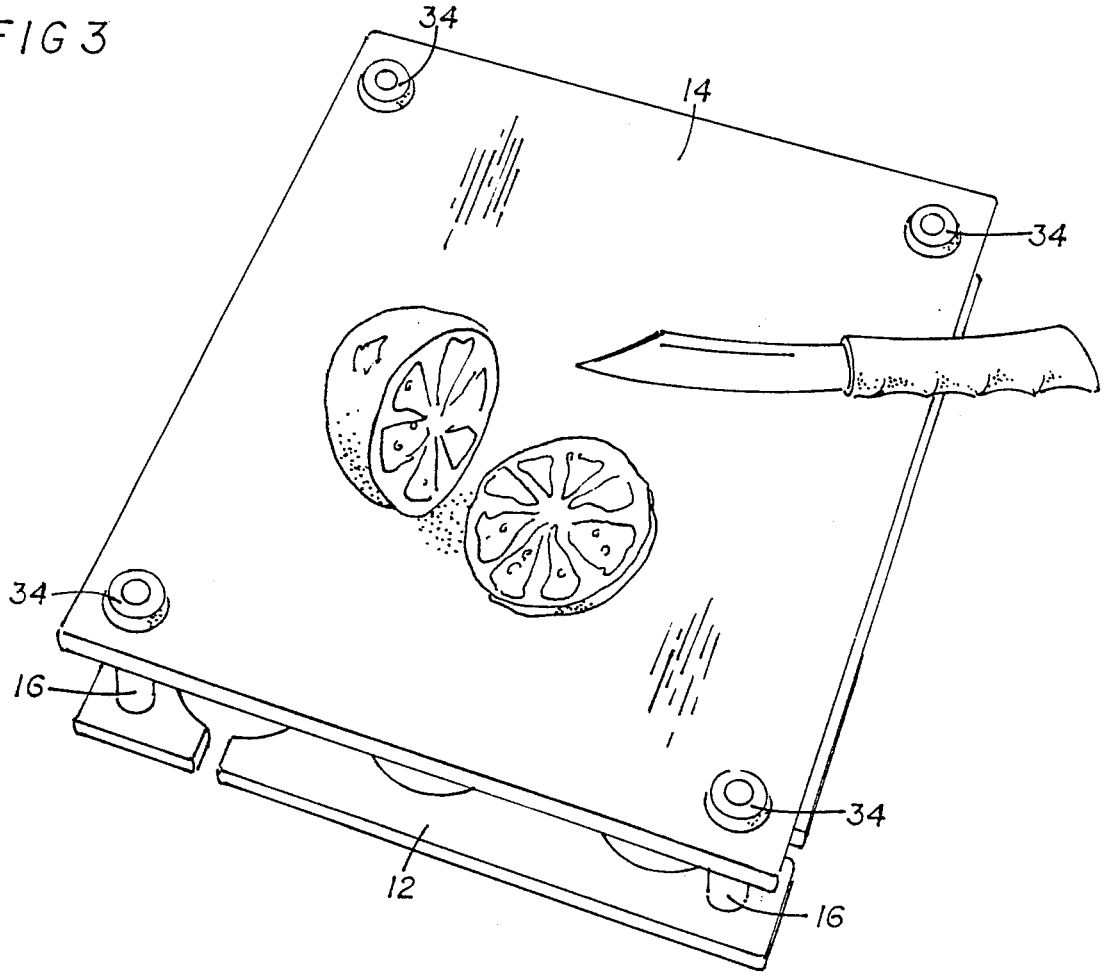
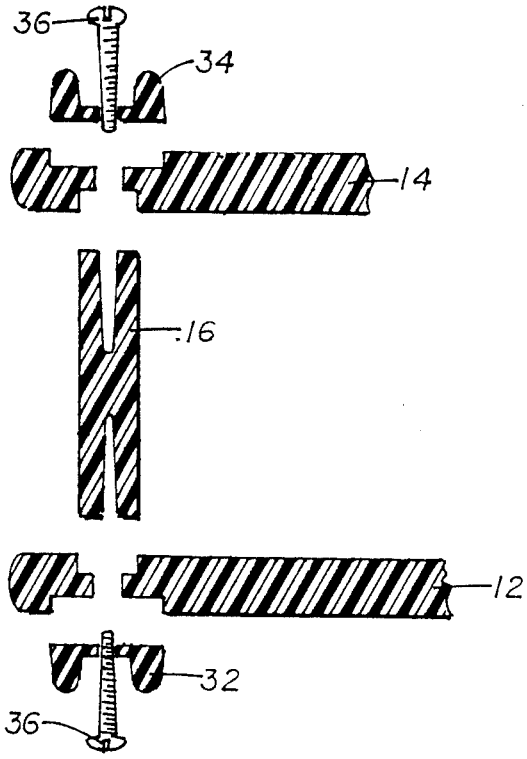
FIG 4

NON-SKID BEVERAGE AND/OR FOOD HOLDER

BACKGROUND OF THE INVENTION

It is well know n in the art to pro vide holders for beverages and food items, to pro vide a stable and effective support therefor in an effort to inhibit the beverages and food items from spilling on the surroundings.

Some of these prior art holders for beverages and food items are low cost components of paper or plastic, with such being extensively used by fast food restaurants and the like.

The Murphy Patent No. 2,547,716 entitled "Foldable Vending Tray for Ice Cream Cups and the Like" is illustrative of one of such low cost carriers for food items.

Somewhat similarly, the Walsh Patent No. 3,480,152 entitled "Storage Rack for Vessel Containing Unstable Material" is illustrative of a storage rack serving to stably support items that have a base of such small size as to require support preventing the item from toppling over.

The Hoch Patent No. 3,893,569 entitled "Thermos Support Tray" is illustrative of a support tray attachable in an automobile upon the floor hump, with the tray being shaped to hold one or more thermos jugs. A plurality of posts 14 in the Hoch device provide a desirable amount of separation between the pair of parallel plates that principally constitute the Hoch tray.

None of these patents, nor any other patents of which I am aware, represent a food and/or beverage holder that possesses stable, non-skid properties making it suitable for use on a table or counter that may be located on a vehicle, such as a boat, train or airplane.

Therefore, it is one of the principal goals of my invention to pro vide a food and/or beverage holder of sturdy, attractive appearance, that is entirely suitable for use on a boat, ship or other such conveyance, where non-spill and non-skid characteristics are of great importance.

SUMMARY OF THIS INVENTION

In accordance with this invention I have provided a novel holder for beverages and/or food items principally constituted by first and second planar members of generally the same size, each of approximately rectangular configuration, with the first planar member having a plurality of apertures therein, in which a beverage container or a food container can be readily placed.

To cause the planar members to reside an appropriate distance apart, I utilize a plurality of columnar members, with such columnar members typically being placed at or near the corners of the first and second planar members. These columnar members can be comparatively short in the event the user intends to use the holder in connection with canned beverages, mugs, dips and the like, whereas longer columnar members are utilized in the event the holder is to be utilized for providing stability to tall stemware, such as champagne glasses or the like. The holder would typically reside on a table, counter, or the like.

Quite advantageously, my novel holder can be double sided, with the apertures on one side of the holder being, for example, configured to hold mugs, beverage cans or the like, whereas upon the holder being turned upside down and replaced on the table or counter, it can then serve as a cutting board, such as might be useful when cutting up fruits or vegetables for salads, or in the preparation of meats for the skillet.

As an alternative to the foregoing, my reversible holder can have apertures in both of its planar surfaces, with the apertures on one side being comparatively small, and the apertures on the other side being comparatively large. It is important to note, however, that the configurations of the two planar members must be compatible, so that the underside of a beverage or food item placed in an aperture on one side of the holder will, if necessary, be supported by the other planar member.

In all instances, my double sided food and/or beverage holder is provided with a plurality of non-skid components such as feet, so that the holder will not slide off the table or counter should the boat or other vehicle in which my holder is used undertake a pitching or a rolling motion, or be confronted with a sudden stop.

It is therefore a principal object of my invention to provide a beverage and/or food holder of attractive, stable construction that will readily serve to support drink and food items in a manner that will effectively prevent spillage, and lessen the likelihood of the food or beverages being spilled due to the motion of a land or water based vehicle.

It is another object of my invention to provide a non-skid beverage and/or food holder concept that is of reasonable cost and usable in a reversible manner, with one side of such holder providing apertures for the support of beverages and food items, with the other side of the holder providing either a cutting board, or else apertures of a substantially different configuration than were present on the one side.

It is yet another object of my invention to provide a food and/or drink holder of highly attractive and easily affordable construction, that in possessing the attributes of being reversible and non-skid, may be advantageously used in a wide variety of sizes and configurations, and usable in many different vehicular, commercial and home applications.

These and other objects, features and advantages will be more apparent from a study of the drawings and other portions of this case.

BRIEF DESCRIPTION OF DRAWINGS

FIG. 1 is a perspective view of a preferred embodiment of a non-skid food and drink holder in accordance with my invention, revealing how the first of two planar members is provided with a plurality of apertures, in each of which apertures, a container for a beverage or a food item can be placed;

FIG. 2 is a fragmentary side view to a larger scale, to reveal the preferred type of columnar member usable at or near each corner of the holder, to hold the planar members in the desired spaced relationship;

FIG. 3 is a perspective view showing that the second planar member may be of a configuration having no aperture therein, making it ideal for use as a cutting board;

FIG. 4 is a side view to a larger scale of one corner of the device shown in FIG. 3, with portions of the second planar member and columnar member being in section to reveal preferred construction;

DETAILED DESCRIPTION

Figure 5:
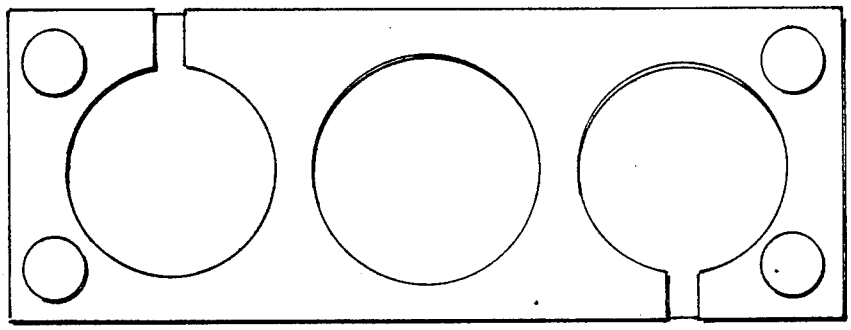
FIG. 5 is a top view of another embodiment of a non-skid food and drink holder in accordance with my invention, in this instance the holder being much longer than it is wide.

With initial reference to FIG. 1 it will there be seen that I have provided a configuration suitable for use with numerous food items, with the holder 10 being principally constituted by a first planar member 12 and a second planar member 14. The first and second planar members are typically of rectangular configuration and of approximately the same size, but I am not to be rigidly limited to this.

As will be noted, there are a plurality of columnar members or posts 16 utilized to maintain a desirable amount of separation between the first and second planar members. As will readily understood, these columnar members 16 are comparatively short when the holder is to be utilized for comparatively short or squat items such as mugs, beverage cans, condiments and the like, whereas comparatively long columnar members are utilized between the planar members when tall items such as champagne glasses are to be supported.

It will be noted that some of the apertures in the first planar member are designed to directly support a food item, cup or the like, whereas other apertures permit the supported item to pass through, and be supported by the planar member underneath.

The first and second planar members are preferably of durable, attractive appearance, and I prefer to utilize high density, stress relieved one-half inch sheet polyethylene or the like in constructing the planar members, although I obviously am not to be limited to this.

With regard to the embodiment of my invention depicted in FIG. 1, the apertures 20 will be noted to be of comparatively large size, as will accommodate a coffee mug or beer mug, as the case may be. Because mugs typically have outwardly extending handles, I usually place a slot 22 extending between the aperture 20 and the near edge of the upper planar member. As is obvious, the handle of the coffee mug or beer mug is intended to reside in the slot 22 at such time as a beer mug or coffee mug is placed in the aperture 20. In this instance, the base of the mug, or of the other items shown in FIG. 1, rests on the inner or interior face of the lower planar member 14.

With continued reference to FIG. 1, it will there be seen that I prefer in this embodiment to have a central aperture 24 of comparatively large size, in which can be placed a dip for use with chips, a beverage having an insulating cover or cozy placed therearound, a thermos jug, or the like. The edges of the bowl in which the dip is placed will ordinarily be contacted by the edges of the aperture, such that the bowl is supported by the upper planar member. On the other hand, a thermos jug placed in the central aperture would logically be supported by the inner or interior face of the lower planar member.

Extending generally around the comparatively large central aperture 24 are four medium size apertures 26, that are suitable for receiving plastic mustard jars, plastic catsup jars, oil and vinegar containers, and the like. As will be further noted in FIG. 1, a small pair of apertures 28 are provided in the planar surface 12 for receiving salt and pepper shakers.

It is to be understood that this embodiment of my invention is of particularly attractive configuration, in addition to being highly utilitarian. Although I am not limited to such, I prefer in the construction of the first and second planar members to utilize high density stress-relieved polyethylene, preferably one-half inch thick, which meets FDA direct food contact requirements. The manufacturer can chose a color of his preference, although I have preferred to utilize white polyethylene in constructing the exemplary products in accordance with this invention.

As will be noted from the embodiment depicted in FIG. 3, I may utilize a planar member having no apertures for food or beverages therein as the second planar member, with the second planar member in the embodiment illustrated in FIG. 3 serving as a cutting board. As an example, such a cutting board can be utilized in the preparation of salads of fruits and/or vegetables, or in the preparation of meat dishes or the like. In either instance the high density polyethylene is rarely damaged from its use as a cutting board, and it makes a clean and highly desirable surface for utilization by a cook or chef.

In FIG. 2 I reveal a preferred configuration for the joining together of the pair of planar surfaces, and it will be noted that the ends of the post or columnar member 16 are intended to be in direct contact with both of the planar members. Because one of the important advantages of my invention can be its versatility and its ability to be used in a dual mode, I prefer to utilize four non-skid members 32 in connection with the external surface of the first planar member 12, and four non-skid members 34 in connection with the external surface of the second planar member 14. Because of this, my beverage and food holder is readily reversible. The non-skid members or feet are preferably secured in place by fasteners such as screws that pass through holes located near the corners of the planar members.

As indicated in FIG. 2, but as revealed in greater detail in FIG. 4, I prefer to recess or counter-bore the inner surfaces of the first and second planar members to a certain small extent, so that the respective ends of the posts or columnar members 16 can be received in such recesses. This construction has several advantages, including an assurance that the beverage and food holder will rest flat on a supporting surface.

Similarly, FIG. 4 shows how the exterior or outwardly facing surfaces of the first and second planar members are recessed or counter-bored to receive the non-skid members, with the result being that my holder for food and/or beverages is very sturdily constructed. Shown in exploded relation in FIG. 4 are a pair of pointed screws 36 that are used not only to hold the non-skid members in the desired position on the respective planar members, but also these screws are of sufficient length to pass through comparatively small holes in the planar members, and enter for a desirable distance into the interior of the post or columnar member 16.

I have found an economical yet very effective constructional technique to involve the columnar members or posts 16 being longitudinally predrilled to a slight extent from each end, utilizing a drill bit or other hole forming means that is of smaller diameter than the screws to be utilized for securing the planar members together.

It is of course possible for me to utilize a single securing means for holding the planar members into the desired relationship with the posts or columnar members 16, with for example a long screw or bolt being utilized that extends entirely through the post or columnar member, as well as both planar members. In such an instance the head of the screw would be at one end, and a nut at the other end.

Another alternative could of course involve a completely threaded member in the nature of a stud, with a nut used at both ends. I usually find it far more preferable, however, to utilize the construction revealed in FIGS. 2 and 4, wherein a pointed screw 36 is initially inserted through a non-skid member or foot 32 or 34, with the screw then extending through a hole in the planar member, then to enter one end of the pre-drilled post or columnar member 16.

With reference now to FIG. 5 it will be seen that the planar members can be decidedly rectangular, as contrasted with being essentially square, with the length of the device shown in FIG. 5 being two or three times its width. As is obvious from FIG. 5, the large central aperture can be entirely circular, whereas the large end apertures may well be provided with slots that will each receive the handle of a beer mug, coffee mug, or the like.

Figure 6:
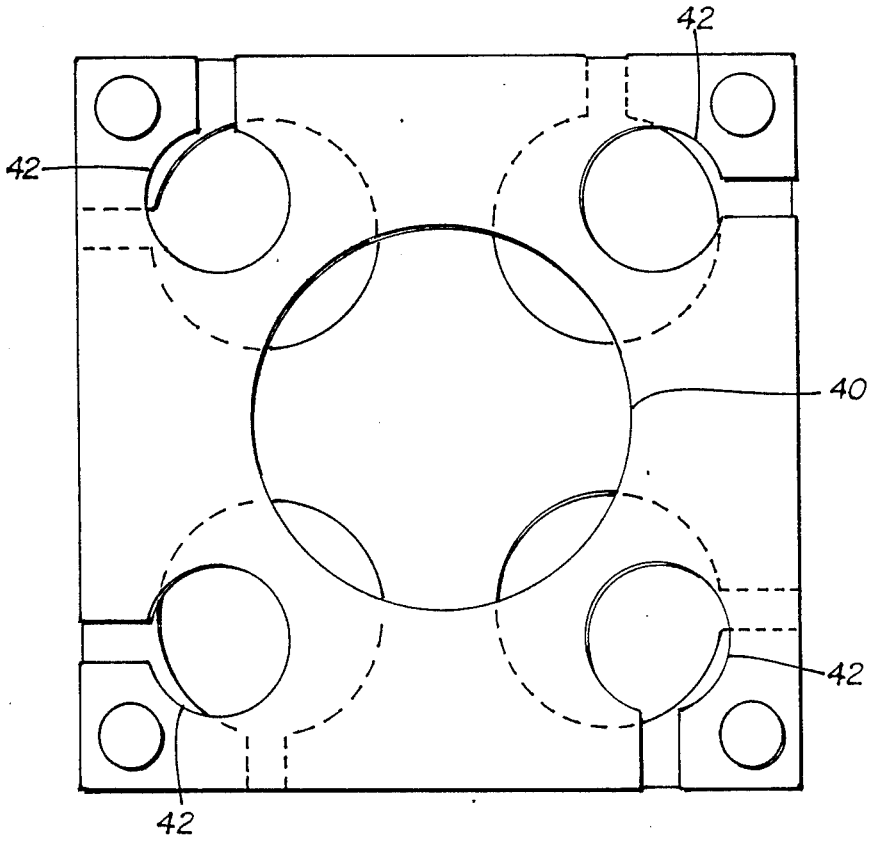
FIG. 6 is still another embodiment of a non-skid food and drink holder in accordance with my invention, this one being ideal for supporting drink containers in the nature of stemware.
Figure 7:
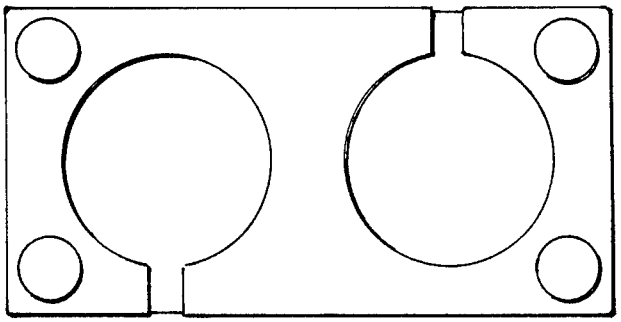
FIG. 7 is an embodiment along the lines of the embodiment of FIG. 5, but utilizing only a pair of apertures, each of which is provided with a slot for receiving the handle of a mug or cup.

FIG. 6 exemplifies an embodiment of my invention in which the central aperture 40 is of considerable size, whereas the four circular apertures 42 surrounding the central aperture are slotted, and are of smaller size. In this instance the apertures 42 are ideally configured to receive and support a goblet of stemware. The slots used with the apertures readily permit the stems to pass through. In FIG. 6 the goblets may be supported by the edges of the smaller apertures 42, or alternatively the bases of the goblets may rest upon a properly configured planar member utilized therebelow.

It is important to note in FIG. 6 that the apertures located in one of the planar members are deliberately out of alignment with the apertures located in the other planar member. This arrangement is such in order to prevent a straight sided container such as a beer can or soft drink can from dropping entirely through the holder should the holder be lifted off of the table or surface upon which it resides.

With regard to my earlier mention of polyethylene being the preferred constructional material for the first and second planar members, polyethylene is a thermoplastic polymer, and a wide variety of grades and formulations are available. I prefer to use High Density Polyethylene, as it is more rigid and harder than lower density materials. It also has higher tensile strength, and as mentioned hereinabove, it meets FDA requirements for direct food contact applications.

The columnar members or posts 16 are preferably made of Ultra-High Molecular Weight Polyethylene (UHMW) which will not encourage growth of bacteria, is self-lubricating, and is approved for direct food contact by the FDA.

The polyethylene I typically use is manufactured by Poly-Hi, a division of Menasha Corporation in Scranton, Pa. It is manufactured in sheet form of various widths, lengths and thicknesses. The process is understood to involve placing polymer pellets in a mold, and by heat and compression, forming the sheets of desired thickness.

I generally purchase the sheet material pre-cut to the sizes required from local suppliers such as Cadillac/-Faulkner Plastics, Inc. of Orlando, Fla. I then punch out the planar member apertures and slots on a hydraulic sheet metal fabricating machine. Each planar member is then counter-bored for the posts and rubber feet on drill presses. Then all aperture edges and all outer edges on both sides of each planar member are routed to a one-quarter inch radius. The columnar members or posts 16 are ordinarily cut to length on a chop saw and then drilled to accept the stainless steel screws 36. The rubber feet 32 and 34 may be those manufactured by Shepard Products U.S., Inc. of St. Joseph, Mich.

It is thus to be seen that I have provided a reversible beverage and/or food holder of pleasing and effective construction, involving a pair of planar members held in a parallel relationship such that food items, beverage cans, condiment holders or the like can be stably held in a non-spill relationship in selected apertures provided in one or both of the planar members. By virtue of having utilized non-skid feet on the outwardly-facing surfaces of each planar member, the holders in accordance with my invention have a non-skid character, irrespective of which planar member is uppermost at a given instant.

I claim:

1. A beverage and/or food holder principally constituted by first and second planar members, each of generally rectangular configuration, a fist of said planar members having a plurality of apertures formed therein, in each of which apertures, a container for a beverage or the like can be placed, said planar members being maintained in a spaced apart, essentially parallel relationship by the use of columnar members utilized at or near the corners of said planar members, and four protruding non-skid members utilized on the underside of said second planar member, adjacent the corners thereof, to resist displacement of said beverage/food holder along a surface upon which it has been placed, even though such surface be of convex contour.

2. The beverage and/or food holder as recited in claim 1 in which said beverage/food holder is reversible, with a plurality of apertures being formed in each of said planar members, with the apertures in one member being deliberately out of alignment with the apertures in the other member, so that the member that is in the lower position at any given moment can serve as a support for each of the containers that may be residing in the apertures in the planar member that at that time is in the upper position.

3. The beverage and/or food holder as recited in claim 1 in which the second of said planar members has no aperture formed therein, thus making available a surface able to serve as a cutting board at such time as said beverage/food holder has been reversed, and said second planar member has been placed in the upper position.

4. The beverage and/or food holder as recited in claim 1 in which said columnar members are comparatively short.

5. The beverage and/or food holder as recited in claim 1 in which said columnar members are comparatively long.

6. A beverage and/or food holder principally constituted by first and second planar members, each of generally rectangular configuration, a first of said planar members having a plurality of apertures formed therein, in each of which apertures, a container for a beverage or the like can be placed, said planar members being maintained in a spaced apart, essentially parallel relationship by the use of columnar members utilized at or near the corners of said planar members, said beverage/food holder being reversible, being usable with either said first or said second planar member in the uppermost position, and with a plurality of protruding non-skid members being utilized on the side of each planar member that faces away from the other planar member.

7. The beverage and/or food holder as recited in claim 6 in which each of said plurality of non-skid members is held in place by a securing member that extends through the respective planar member, to engage the respective columnar member.

8. A reversible beverage and/or food holder principally constituted by first and second planar member s, each of generally rectangular configuration, a first of said planar members having a plurality of apertures formed therein, in each of which apertures, a container for a beverage, food item or the like can be placed, said planar members being maintained in a spaced apart, essentially parallel relationship by the use of columnar members utilized at or near the corners of said planar members, the ends of said columnar members in each instance being in touching contact with the near or adjacent sides of said planar members, and a plurality of somewhat protruding non-skid feet attached to the non-adjacent side of each of said planar members, so that irrespective of which planar member of said holder is uppermost at a given moment, a plurality of said feet will be in place to resist said holder skidding along a surface upon which it has been placed.

9. The reversible beverage and/or food holder as recited in claim 8 in which each of said plurality of non-skid feet is held in place by a securing member that extends through the respective planar member, to engage the respective columnar member.

10. The reversible beverage and/or food holder as recited in claim 8 in which a plurality of apertures is formed in each of said planar members, with the apertures in one member being deliberately out of alignment with the apertures in the other member, so that the member that is in the lower position at any given moment can serve as a support for each of the containers that may be residing in the apertures in the planar member that at that time is in the upper position.

11. The reversible beverage and/or food holder as recited in claim 8 in which the second of said planar members has no aperture formed therein, thus making available a surface able to serve as a cutting board at such time as said-beverage and/or food holder has been reversed, and said second planar member has been placed in the upper position.

12. The beverage and/or food holder as recited in claim 8 in which said columnar members are comparatively short.

13. The beverage and/or food holder as recited in claim 8 in which said columnar members are comparatively long.

* * * * *